US011142893B2

(12) United States Patent
Dare et al.

(10) Patent No.: US 11,142,893 B2
(45) **Date of Patent: *Oct. 12, 2021**

(54) WEAR MEMBER FOR EARTH WORKING EQUIPMENT

(71) Applicant: ESCO Group LLC, Portland, OR (US)

(72) Inventors: Michael C. Dare, Brighton (AU); Rodney K. Clarke, Cleveland (AU); Junbo Qian, Westlake (AU); Matthew J. Dunford, Brisbane (AU); Sean G. Moore, Norman Park (AU); Geoffrey R. Hodges, Kallangur (AU); Jared R. Ames, Portland, OR (US); Joel S. Hankland, Canby, OR (US)

(73) Assignee: ESCO GROUP LLC, Portland, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/039,607

(22) Filed: Jul. 19, 2018

(65) Prior Publication Data

US 2019/0003156 A1 Jan. 3, 2019

Related U.S. Application Data

(62) Division of application No. 15/279,806, filed on Sep. 29, 2016, now Pat. No. 10,030,367.

(60) Provisional application No. 62/234,473, filed on Sep. 29, 2015.

(51) Int. Cl.
*E02F 9/28* (2006.01)
*E02F 3/40* (2006.01)

(52) U.S. Cl.
CPC ..... *E02F 9/2833* (2013.01); *E02F 3/40* (2013.01); *E02F 9/2808* (2013.01); *E02F 9/2883* (2013.01)

(58) Field of Classification Search
CPC .... B60B 3/14; F16B 37/00; E02F 9/28; E02F 9/2833; E02F 9/2883; E02F 9/2858; E02F 9/285; E02F 9/2825; E02F 9/2808; E02F 3/40
USPC ..... 37/446, 452–460; 280/86.753; 411/398, 411/427
See application file for complete search history.

(56) References Cited

U.S. PATENT DOCUMENTS

| | | | |
|---|---|---|---|
| 858,394 | A | 7/1907 | Hutton |
| 1,044,055 | A | 11/1912 | Johnson et al. |
| 1,740,739 | A | 12/1929 | Kipp |
| 3,006,443 | A | 10/1961 | Siler |
| 3,041,913 | A | 7/1962 | Liska |
| 3,493,249 | A | 2/1970 | Conrad, Jr. et al. |

(Continued)

FOREIGN PATENT DOCUMENTS

| | | |
|---|---|---|
| EP | 1852557 | 8/2008 |
| SU | 1492042 | 7/1989 |

*Primary Examiner* — Thomas B Will
*Assistant Examiner* — Joel F. Mitchell
(74) *Attorney, Agent, or Firm* — Steven Schad; Palmer Dzurella

(57) ABSTRACT

A wear member and fastener for securing the wear member to earth working equipment. The fastener can be installed and maintained from the top of the assembly. An eccentric retainer is received in a recess of the wear member and is rotated to shift the wear member rearward on the earth working equipment. A bolt passing through aligned openings of the earth working equipment and the wear member is received by the retainer to secure the wear member to the earth working equipment.

19 Claims, 10 Drawing Sheets

(56) References Cited

U.S. PATENT DOCUMENTS

| | | | | |
|---|---|---|---|---|
| 3,762,079 | A * | 10/1973 | Lukavich | E02F 3/40 37/451 |
| 3,845,578 | A | 11/1974 | Holmstrom | |
| 4,027,408 | A | 6/1977 | Ramella et al. | |
| 4,056,893 | A | 11/1977 | Willard | |
| 4,077,142 | A | 3/1978 | Klett et al. | |
| 4,407,081 | A | 10/1983 | Hanson | |
| 5,387,047 | A | 2/1995 | Korpi | |
| 5,713,145 | A | 2/1998 | Ruvang | |
| 5,913,605 | A | 6/1999 | Jusselin et al. | |
| 6,503,039 | B2 * | 1/2003 | Ward | F16B 37/00 280/86.753 |
| 6,725,582 | B2 | 4/2004 | Adamic et al. | |
| 6,848,203 | B2 | 2/2005 | Hohmann et al. | |
| 6,928,759 | B2 | 8/2005 | Kasim | |
| 6,959,506 | B2 | 11/2005 | Adamic et al. | |
| 7,266,914 | B2 | 9/2007 | Grant | |
| 7,455,471 | B2 | 11/2008 | Gawehn | |
| 7,472,503 | B2 * | 1/2009 | Maher | E02F 9/2841 37/452 |
| 7,603,799 | B2 | 10/2009 | Campomanes | |
| 7,770,310 | B2 | 8/2010 | Keech | |
| 8,127,476 | B2 | 3/2012 | Bierwith | |
| 8,281,505 | B2 | 10/2012 | Karlsson | |
| 8,707,590 | B2 | 4/2014 | Hughes | |
| 8,770,311 | B2 | 7/2014 | Rivera et al. | |
| 8,776,408 | B2 | 7/2014 | Vaughan | |
| 8,943,718 | B2 | 2/2015 | Ruvang | |
| 8,959,807 | B2 | 2/2015 | Lahood et al. | |
| 9,074,351 | B2 | 7/2015 | Ballinger | |
| 9,121,160 | B2 | 9/2015 | Hughes | |
| 9,315,972 | B2 | 4/2016 | Anisy et al. | |
| 9,404,240 | B2 | 8/2016 | Kunz | |
| 9,518,379 | B2 | 12/2016 | Kunz | |
| 2004/0098886 | A1 | 5/2004 | Hohmann et al. | |
| 2014/0325881 | A1 | 11/2014 | Plouzek | |
| 2014/0360061 | A1 | 12/2014 | Kunz | |
| 2015/0052787 | A1 | 2/2015 | Diaz et al. | |

* cited by examiner

WEAR MEMBER FOR EARTH WORKING EQUIPMENT

This application is a divisional of pending application Ser. No. 15/279,806, filed Sep. 29, 2016, entitled "WEAR MEMBER FOR EARTH WORKING EQUIPMENT," which claims priority to U.S. Provisional Patent Application No. 62/234,473, filed Sep. 29, 2015. Each of these applications are incorporated by reference herein in its entirety and made a part hereof.

FIELD OF THE INVENTION

The field of the present disclosure relates to wear members for earth working equipment.

BACKGROUND OF THE INVENTION

During mining and construction operations, replaceable wear members are typically used to protect earth working equipment such as excavation buckets. During use, the wear members gradually wear down due to the abrasive conditions and heavy loading. Once depleted, the wear members are removed from the equipment and replaced. Using wear members provides a cost-effective approach to digging and other earth working operations because it lessens the need of having to repair or replace the more expensive underlying equipment such as the lip or other portions of the equipment.

Wear members are commonly secured to earth working equipment by mechanical means (for example, a lock pin, bolt, or other locking mechanism). During earth working operations, wear members may be subjected to a variety of directional forces, which can include axial, vertical, and lateral loads. The various locks of the past have sought with varying degrees of success to ensure the wear members can remain attached under the application of high forces, be easy, quick and safe to install and remove, and/or tighten the wear member against the underlying equipment.

SUMMARY OF THE INVENTION

The present invention pertains to wear members for earth working equipment that are mechanically secured to the equipment. The wear assemblies of the invention are reliable, safe, easy to use, able to provide take up, and/or replaced with little machine downtime.

In one embodiment of the invention, the wear member is attached with an eccentric retainer that provides take up of the wear member when installed. The wear member is installed and maintained from an accessible surface of the earth working equipment (e.g., above a lip) for improved ease and/or safety of the user.

In another embodiment of the invention, the wear member is secured to earth working equipment by a fastener that includes an eccentric retainer for take up and a cooperating tightening member. The retainer is retained to the wear member during installation. In one preferred construction, the retainer is retained by a resilient member inserted and held in an opening with the retainer. In one construction, the operator need not access the retainer or tightening member underneath the equipment during installation and/or removal.

In another embodiment of the invention, a wear member includes an opening for receiving a retainer to cooperate with a tightening member to secure the wear member to earth working equipment. The retainer and opening include cooperating tabs to retain the retainer in the opening during installation of the wear member on the equipment. In one construction, a resilient member is inserted into the opening to resist inadvertent release of the retainer from the opening during installation.

In another embodiment of the invention, a wear member includes an opening with one or more radial slots to receive one or more tabs extending from a retainer used to secure the wear member to earth working equipment. The retainer is movable within the opening to overlap the tabs to prevent unintended removal of the retainer from the opening during installation of the wear member. In one construction, a resilient member resists realignment of the slots and tabs during installation of the wear member.

In another embodiment of the invention, the wear member has an opening extending through a mounting portion for receiving a retainer of a fastener securing the wear member to earth working equipment. The opening includes a converging bearing surface against which the retainer bears to secure the wear member and initiate take up of the wear member. In one construction, the bearing surface converges toward an open end in an accessible surface of the mounting portion, and the opening receives the retainer through an opposite surface of the mounting portion.

In another embodiment of the invention, a retainer for securing a wear member to earth working equipment includes a body with an axially extending threaded feature at a proximal end aligned with and offset from a main axis of the body. The axial threaded feature is a bore or shank that cooperates with a bolt or nut to tighten the wear member against the equipment in a direction along the threaded feature and transverse to the threaded feature.

In another embodiment of the invention, a wear assembly includes a lip of a bucket with an opening extending between top and bottom surfaces. A wear member is mounted to the lip with an opening in a lower leg that aligns with the opening in the lip. A bolt passes through the aligned openings and connects to an eccentric retainer in the opening of the wear member to secure the wear member and provide the wear member with take up.

In another embodiment of the invention, a method of securing a wear member to earth working equipment includes installing an eccentric retainer with a bore in a recess of the wear member, mounting the wear member with the retainer on a lip with an opening through the lip, rotating the retainer to align the bore with the opening of the lip; and receiving a bolt through the lip opening and into the bore of the retainer to secure the wear member to the lip.

In another embodiment of the invention, a wear member for a digging edge of an excavation bucket includes bifurcated legs that receive the digging edge. An opening in one leg opens to a top surface of the leg and diverges to open at a lower surface of the leg. The wear member includes an eccentric retainer free to rotate in the opening.

In another embodiment of the invention, a method of removing a shroud from a lip includes at a top surface of the lip torqueing a fastener engaging an eccentric component. Rotating the eccentric component in a recess of the shroud and rotating a radially extending tab of the eccentric component through a radially extending circumferential slot. Rotation of the eccentric component is limited by contact of the tab with a stop in the slot. The fastener is separated from the eccentric component and the shroud is separated from the lip.

In another embodiment of the invention, a wear member is secured to earth working equipment using at least one eccentric retainer installed in the wear member prior to mounting the wear member on the lip. The eccentric retainer receives at least one driver following placement of the wear member on the lip to pull the wear member tightly on the lip and hold the wear member to the lip during digging.

In another embodiment of the invention, at least a first component of a retainer is secured in an opening in a wear member prior to installation on earth working equipment by a resilient member fit in the opening. In one construction, the resilient member is retained in the opening by tabs or in a slot that support an un-flexed resilient member from falling out of the opening.

In another embodiment of the invention, a first component of a fastener is secured to a bottom leg of a shroud prior to installation of the wear member on a digging edge, and a second component of a fastener interacts with the first component after installation of the shroud on the digging edge. In one construction, the fastener is accessed for installation and removal of a shroud on a lip completely from above the lip so the operator does not have to get under the bucket, which provides a safer procedure.

In another embodiment of the invention, a shroud is secured to a digging edge of a bucket by a retainer that pulls the shroud tightly onto the digging edge and securely holds the shroud on the digging edge during digging.

In another embodiment of the invention, a wear member is secured to the digging edge of an excavation bucket. The wear member includes a bifurcated mounting portion that receives the digging edge. The mounting portion includes a plurality of slots or recesses and one or more bosses for receiving a corresponding fastener.

In another embodiment of the invention, a fastener includes an eccentrically-shaped, retainer having one or more recesses corresponding to one or more bosses of a wear member to securably receive the retainer, where the eccentric shape of the retainer exerts a rearwardly directed force on the wear member resulting in the wear member being pulled onto a digging edge of an excavation bucket when the retainer is turned. To maintain the secure connection between the digging edge and the wear member, a bolt or other driver is inserted through the wear member to engage the retainer.

In another embodiment of the invention, fastener components may be pre-installed on the shroud prior to attaching the shroud to the digging edge of a bucket so as to simplify installation and increase safety. In one construction, to retain the fastener component in the shroud, a disc member (e.g., a washer) may be fit into an opening to support the fastener until bolts or other securing members are installed to engage the fastener component to attach the shroud to the digging edge.

The various above-noted aspects of the invention can be used independently of each other or collectively with all or some of the different aspects of the invention in securing a wear member to excavating equipment. The noted aspects are exemplary summary observations of certain ideas of the various concepts of the invention and are not intended to be exhaustive or essential. The foregoing and other objectives, features, and advantages of the disclosed embodiments will be more readily understood in view of the following detailed description of certain embodiments and the accompanying drawings. Understanding that the drawings depict only certain embodiments and are not, therefore, to be considered limiting in nature, these embodiments will be described and explained with additional specificity and detail.

DETAILED DESCRIPTION OF DISCLOSED EMBODIMENTS

Wear members are applied to many kinds of earth working equipment to extend the service life of the equipment. The present invention is related to wear members and locking systems for securing the wear members to the earth working equipment.

The invention is described herein in the context of a shroud for a load-haul-dump (LHD) bucket. It should be understood that this is merely one example of the disclosed subject matter and is not meant to be limiting. Shrouds in accordance with the present invention may have other constructions for use on a wide variety of excavating buckets including, for example, buckets for hydraulic excavators, loaders, cable shovels, face shovels, etc., or for use on other products such as ripper teeth. In other embodiments, the wear member may have a construction other than a shroud, which in one example could be a runner. The wear members may be secured to a lip, to a base secured to the lip, to other portions of a bucket, or to other earth working equipment. Relative terms such as top, bottom, forward and rearward are used herein for ease of discussion and are not intended to be limiting.

Figure 1:
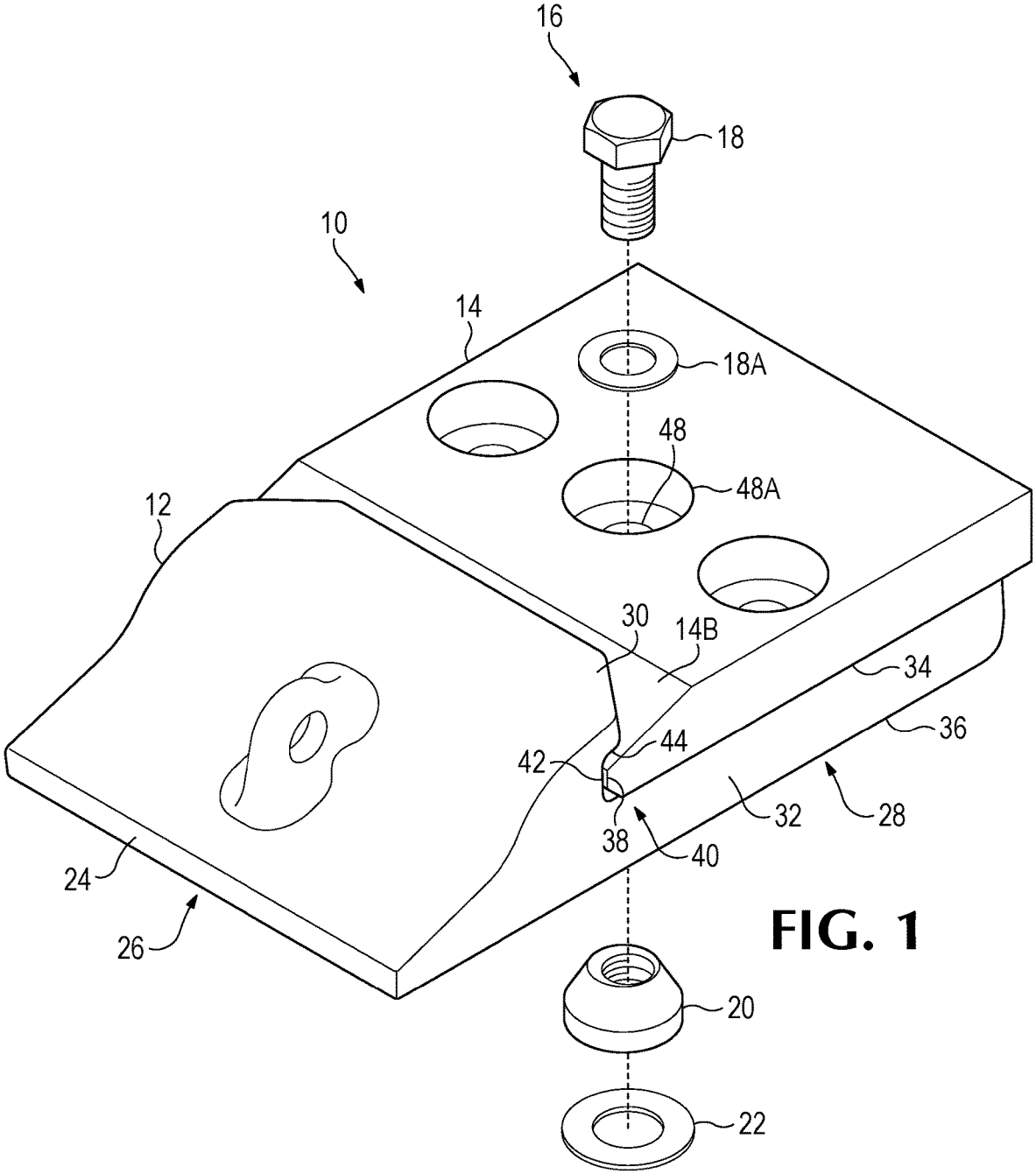
FIG. 1 is an upper perspective view of a wear assembly with an exploded view of the fastener.
Figure 2:
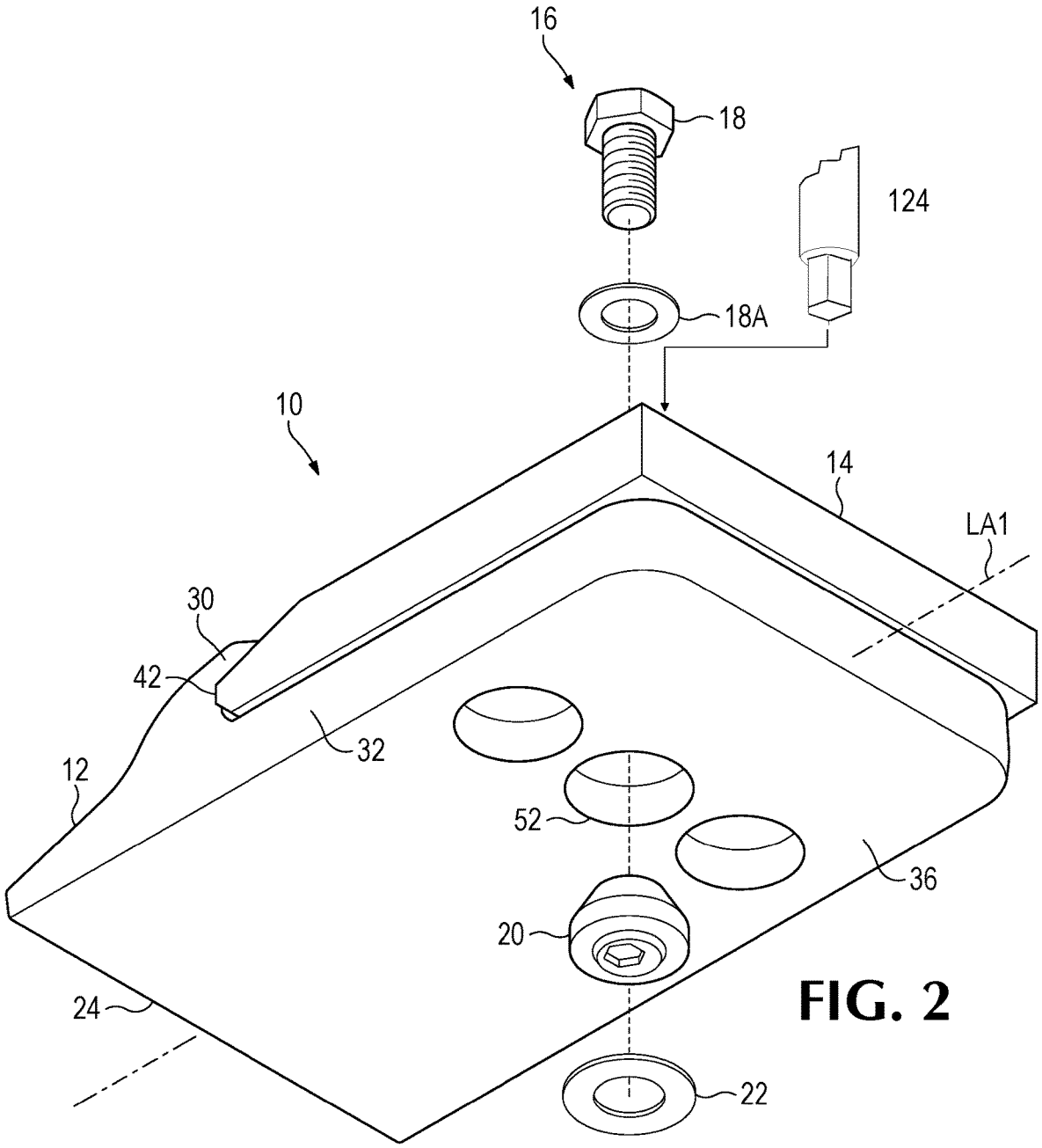
FIG. 2 is a lower perspective view of the wear assembly of FIG. 1 with an exploded fastener.
Figure 3:
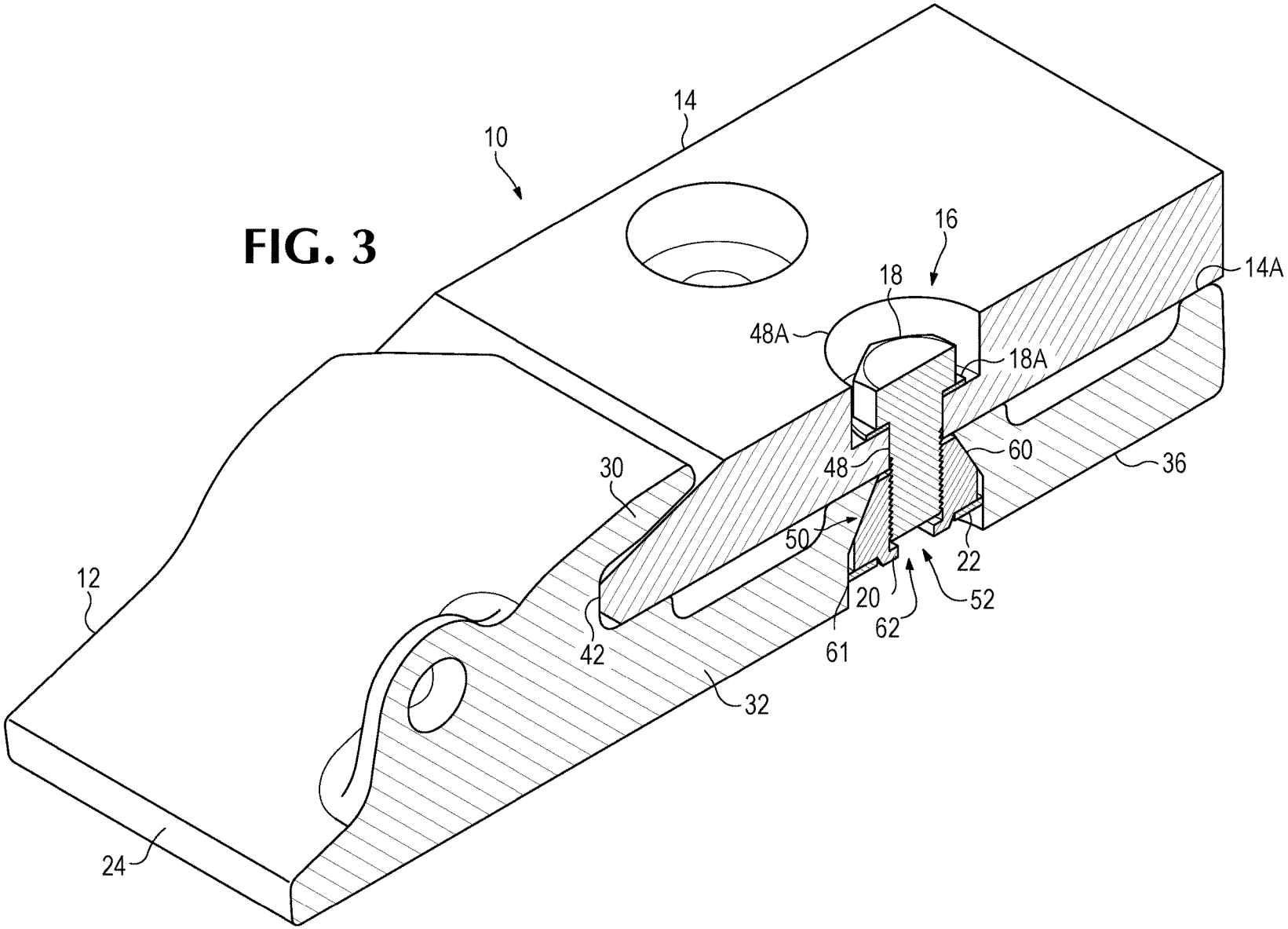
FIG. 3 is a cross section perspective view of the wear assembly of FIG. 1 taken along the longitudinal axis of the wear assembly.
Figure 4:
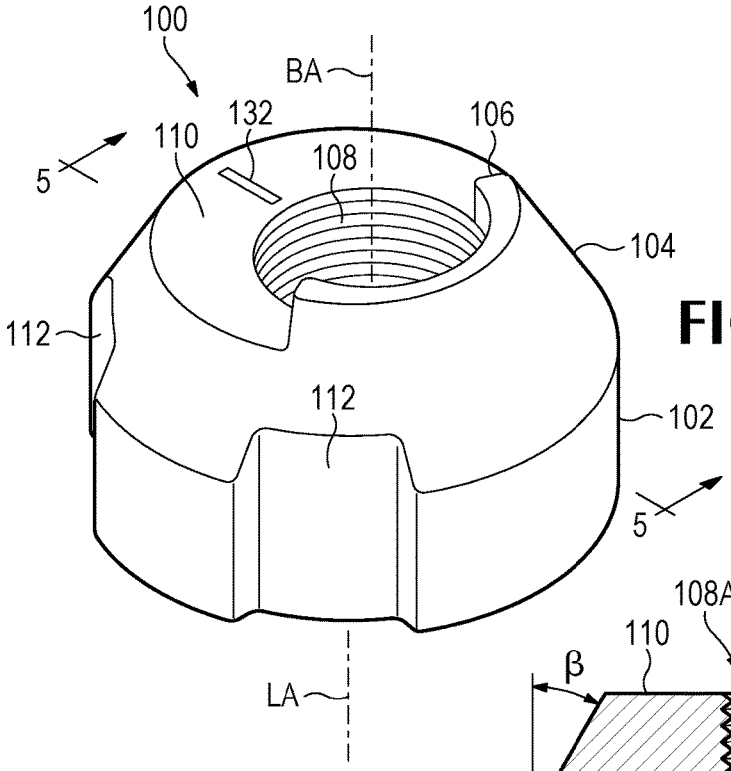
FIG. 4 is a perspective view of a retainer of a second embodiment.
Figure 5:
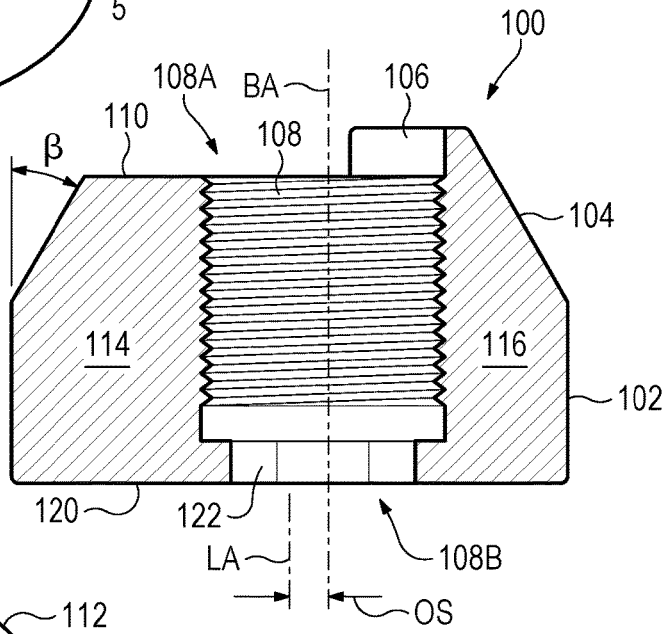
FIG. 5 is a cross section view of the retainer of FIG. 4 taken along line 5-5 in FIG. 4.
Figure 6:
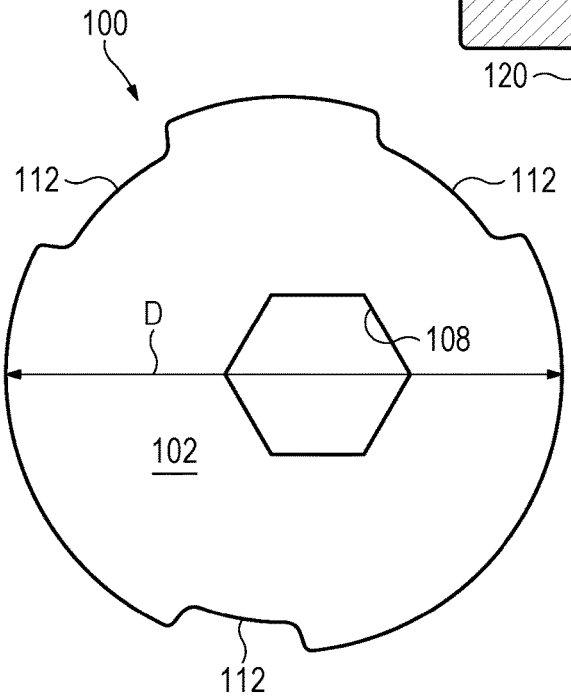
FIG. 6 is a bottom view of the retainer of FIG. 4.
Figure 8:
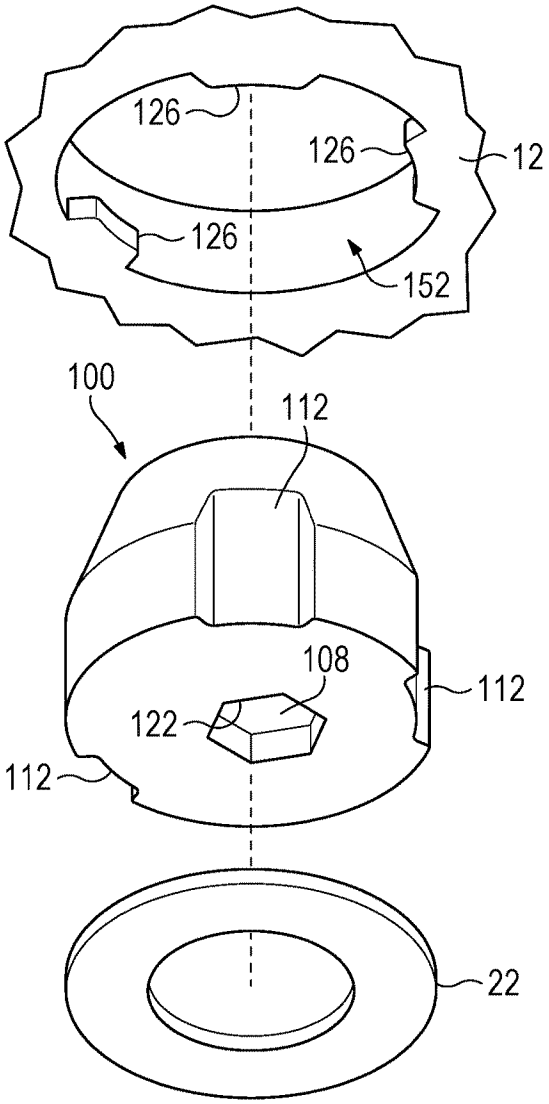
FIG. 8 is an exploded view of the retainer and shroud recess of FIG. 7.
Figure 7:
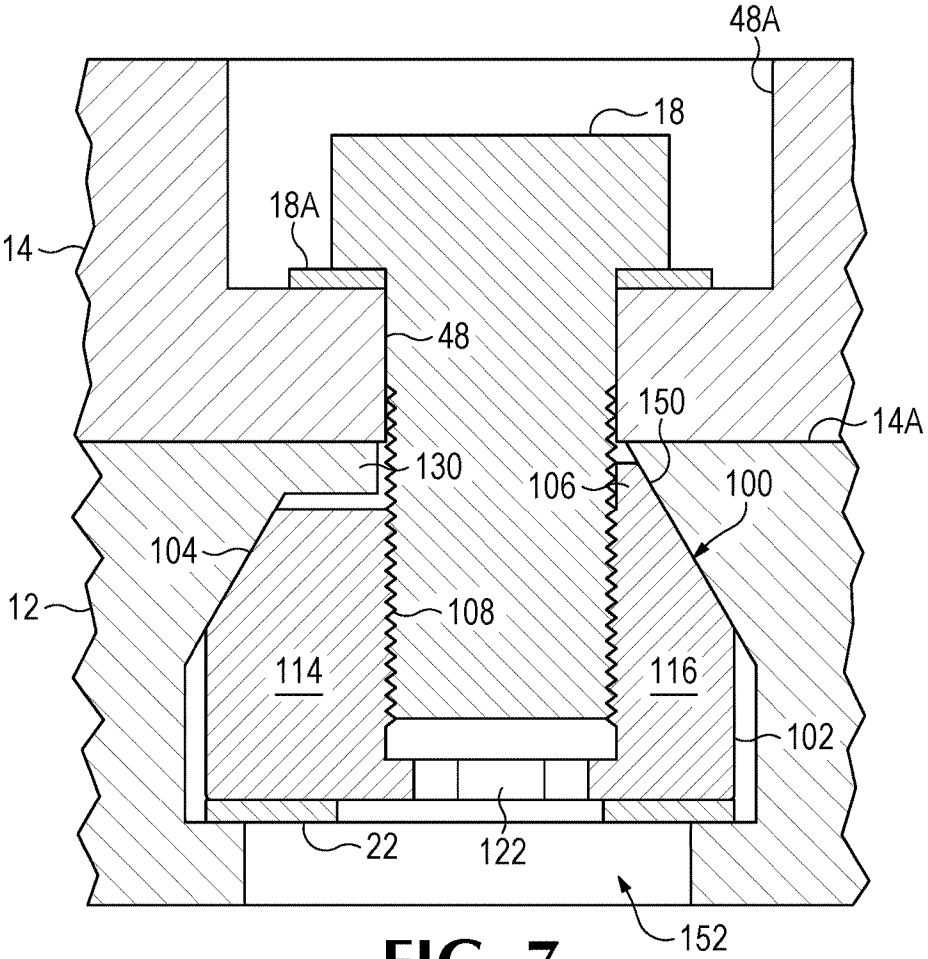
FIG. 7 is a cross section view of a portion of a wear assembly taken through the center of the fastener with the retainer of FIG. 4.
Figure 9:
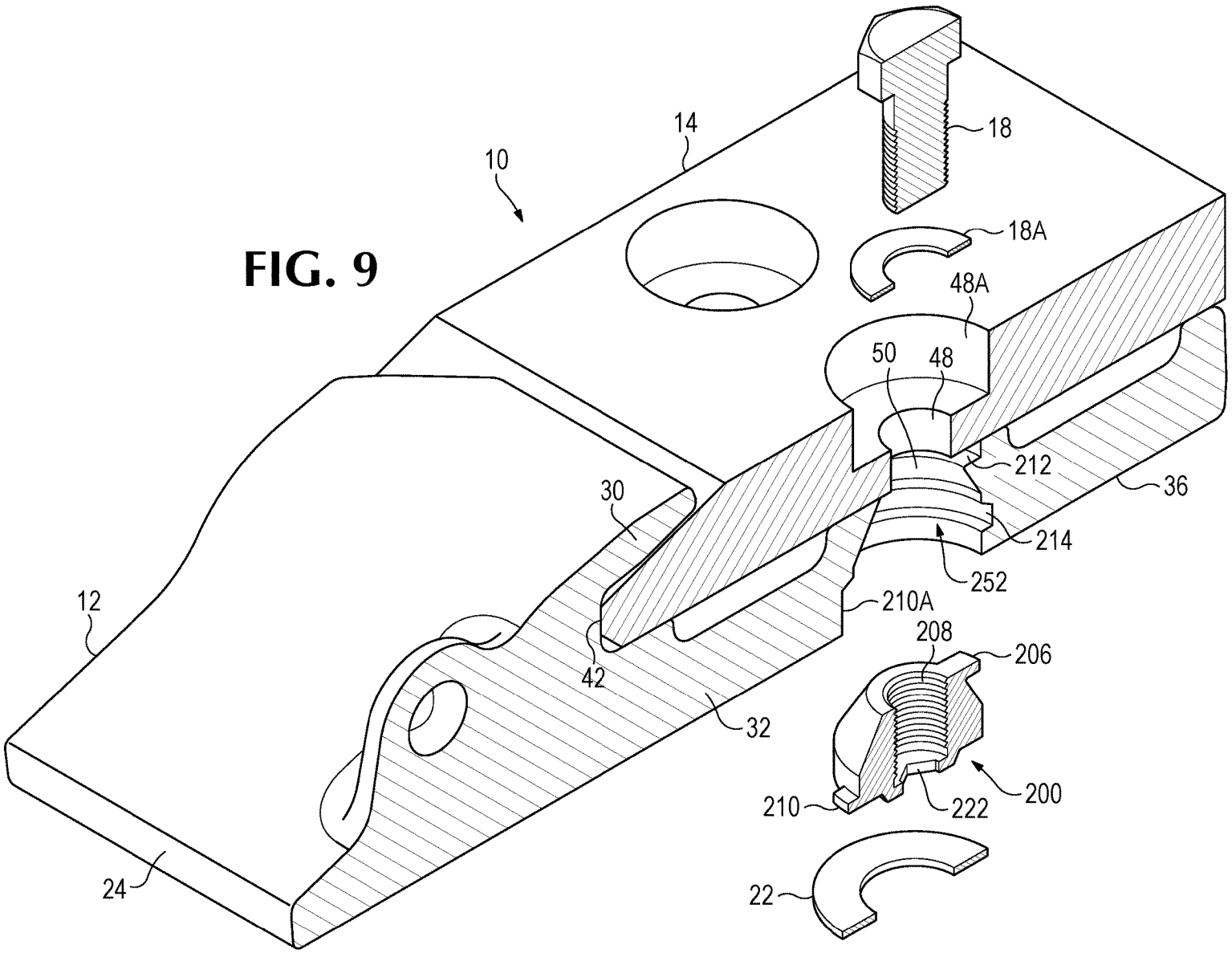
FIG. 9 is a perspective view of another embodiment of a wear assembly with an exploded view of a fastener.
Figure 10:
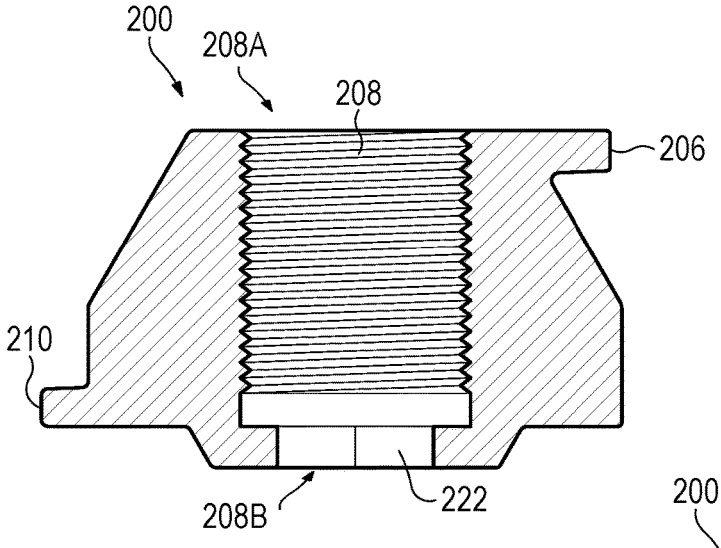
FIG. 10 is a cross section view of the retainer of FIG. 9 taken along line 10-10 in FIG. 11.
Figure 11:
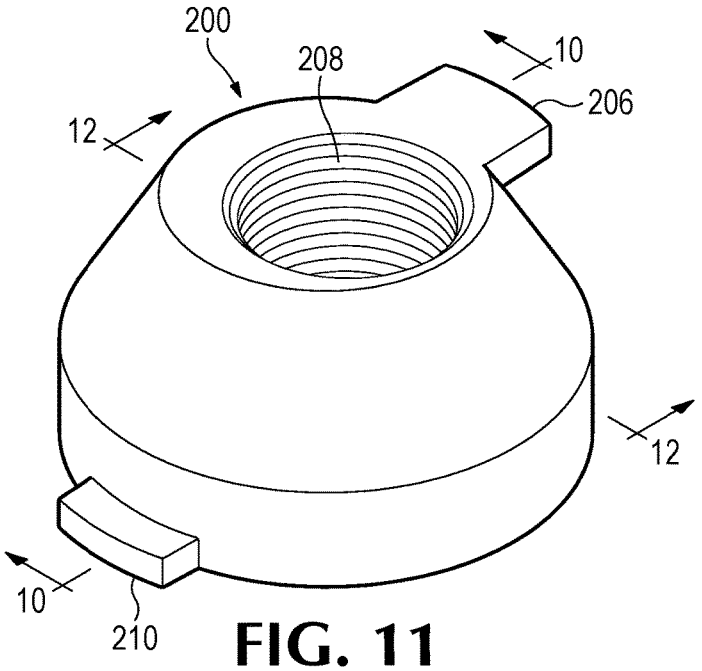
FIG. 11 is a perspective view of the retainer of FIG. 9.
Figure 12:
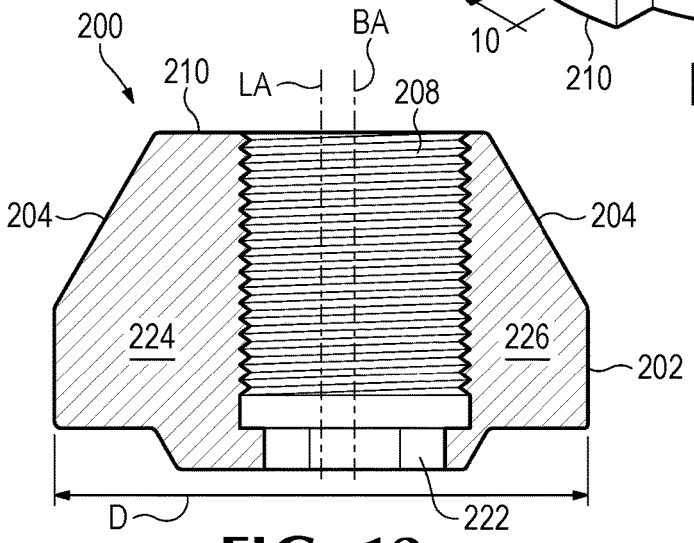
FIG. 12 is a cross section view of the retainer of FIG. 9 taken along line 12-12 in FIG. 11.
Figure 13:
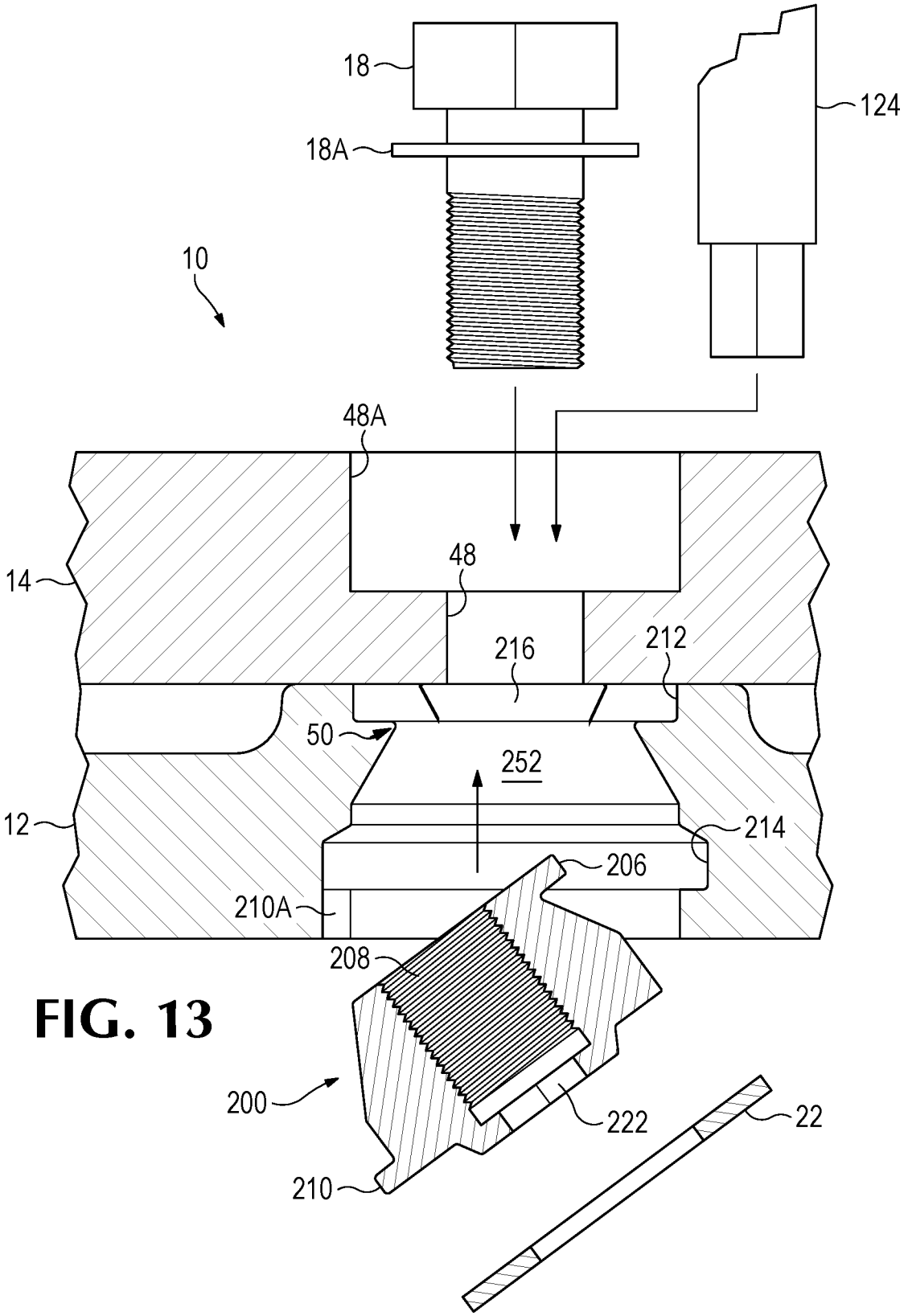
FIG. 13 is a cross section exploded view of a portion of the wear assembly of FIG. 9 illustrating assembly of the fastener in the wear assembly.
Figure 14:
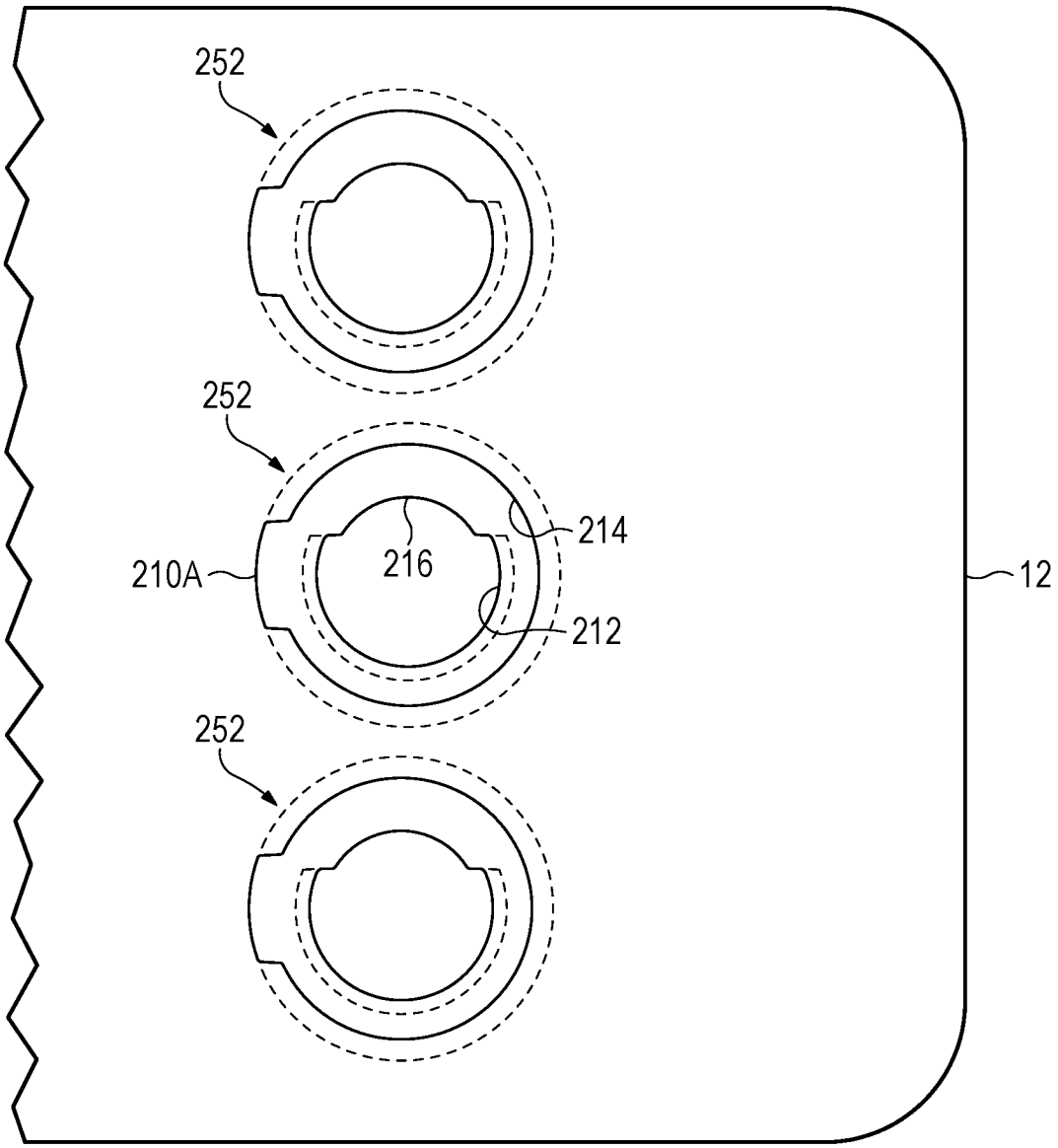
FIG. 14 is a partial bottom view of the wear assembly of FIG. 9.

FIGS. 1-3 show one embodiment of a wear assembly 10 including a wear member 12 for attachment to earth working equipment. In one illustrated example, the wear member is a shroud 12 attached to a lip 14 of an LHD bucket. The lip 14 forms a front digging edge of the bucket. Shrouds in accordance with the invention may also be secured to the sidewalls of the bucket (not shown). The shroud 12 preferably includes a plurality of openings 50 that align with a plurality of lip openings 48. The aligned openings 48, 50 each receives a fastener 16. Each fastener preferably includes an eccentrically-shaped retainer or head 20 and a bolt or other tightening member 18. The use of a plurality of fasteners provides additional strength and redundancy to reduce the risk of losing the wear member during use. While three fasteners are shown, other numbers of fasteners could be used. A single fastener could also be used.

The shroud 12 includes a working portion 26 and a mounting portion 28. In this embodiment, the working portion tapers to a narrowed front working edge 24. During use, the working portion 26 contacts the earth or other material during the excavation process to protect the lip, ease penetration and/or gather material in the bucket. The mounting portion 28 includes an elongated base 32 that extends rearward along the lip and an abutment or end wall 42 to contact the front edge of the lip. In this embodiment, mounting portion 28 includes a top leg 30 opposite base or bottom leg 32, with the top leg 30 preferably being shorter in length as compared to leg 32 though other arrangements are possible. The top leg 30 includes a chamfered or beveled bottom surface 44 having an angle of inclination generally corresponding to the beveled lip front surface 14B. The end wall 42 between legs 30, 32 preferably abuts the front of the lip 38 when the shroud is fully installed on the lip. Other arrangements for other lips are possible. The bottom leg 32, in this embodiment, includes a top surface 34 to meet the generally planar bottom of the lip 14A and an opposite bottom surface 36. Opening 50 extends entirely through the bottom leg 32 from the top surface 34 to the bottom surface 36.

Opening 50 receives retainer 20 of fastener 16. Opening 50 includes a bearing wall that diverges downward to bear against retainer 20. In one embodiment, the bearing wall 60 diverges from the top or inner surface of leg 32 but other arrangements are possible. For example, a bore could connect the bearing wall to the top surface of leg 32. A cylindrical wall 61 extends downward from the bearing wall 60 to circumscribe retainer 20 but other shapes are possible. Retainer 20 is received into opening 50 such that it can turn about an axis. Retainer 20 preferably has an eccentric configuration to provide take up for the shroud.

Bolt 18 passes through the lip opening 48 and into opening 50 to engage a threaded bore 62 in retainer 20, and maintain a secure mechanical connection between the lip 14 and the shroud 12. Opening 48 of lip 14 can include a countersink 48A to accept the head of the bolt below the surface of the lip. Rotation of bolt 18 pulls retainer 20 against bearing surface 60, and turns the retainer to move the shroud 12 rearwardly farther onto the lip 14 and seat abutment 42 against the front edge 38 of lip 14. When the shroud 12 is worn beyond an acceptable performance level, the bolts 18 are disengaged, and the shroud 12 is removed from the lip 14 and replaced.

When the shroud 12 is installed onto the lip 14, the front surface 38 of the lip 14 is inserted into a slot 40 between the legs 30, 32 of the mounting portion 28, with the generally planar underside 14A of the lip 14 resting against the top surface 34 of leg 32. A fastener 16 is inserted into each of the aligned openings 48, 50 to secure the shroud 12 onto the lip 14. While a fastener with a threaded bolt and threaded bore in the retainer is described, other types of fastener assemblies could be used to secure shroud 12 to the lip. The fastener 18 can, for example, use a Storz type connection or a bayonet type connection. Alternatively, the fastener can function as a rivet in the bore.

A holding member 22 is optionally fit into the opening underneath the retainer to retain the retainer in the opening during installation of the wear member on the lip. In this embodiment, the retainer is a resilient member frictionally secured in the opening. Nevertheless, the holding member could be rigid and/or the use of tabs, a latch or other means could be used to secure the holding member in place. Alternatively, the retainer could be secured in the opening with a latch or other means incorporated into the retainer.

In one embodiment shown in FIGS. 4-7, fastener 16 includes an eccentric retainer 100 received in an opening or recess 152. Retainer 100 includes a base portion 102, which is generally cylindrical, and a cap portion 104 as a truncated cone. The base and cap portions, though, could have other shapes. In one example, the cap portion may conform to a portion of a sphere. Bore 108 of retainer 100 is eccentrically positioned to create a narrow side portion 116 and a wide side portion 114. Retainer 100 has a longitudinal axis LA (also referred herein as a retainer axis or main axis) through the geometric center of the retainer and a bore 108 with axis BA that has an offset OS from and is parallel or aligned with the longitudinal axis. The retainer has a diameter D. The bore axis BA can be offset from the retainer axis LA, for example, by at least 5% of the value D, though other offsets that are larger or smaller are possible. In one example, the bore axis can be offset from the retainer axis at least 10% of the value D. The diameter of shroud opening 152 accommodates the offset of the bolt in the bore and can be larger than the diameter of the lip opening 48. Rotation of the retainer in opening 152 can draw the shroud 12 onto the lip 14 as torque is applied to the bolt. This take up of the shroud is due to the eccentricity of the retainer.

The cap portion 104 generally tapers inwardly from the base portion 102 toward a top surface 110. In some embodiments, the cap portion 104 may taper at an angle β ranging between 45 and 75 degrees. In other embodiments, the angle β may range between 50 and 60 degrees. Smaller and larger taper angles may also be used. Preferably, the cap portion 104 tapers at the same angle β on both sides of the cap 104, that is, the cap portion 104 tapers at a constant angle from both the narrow side portion 116 and the wide portion 114 of the retainer 20. Other arrangements are possible; e.g., different angles and non-uniform inclinations can be used. The cap portion can be arcuate in cross section. The retainer can be generally symmetric about the longitudinal axis LA.

Retainer 100 can include a lug 106 extending upwardly from the top surface 110. Rotation of retainer 100 may be limited by lug 106 contacting a stop 130 formed in opening 152. In some embodiments, the top surface 110 may include a marker 132 (e.g., a slot, a marking, or other suitable feature). The marker provides a visual indication of the rotational position of the retainer 100 in recess 152. In one example, when the retainer is fully installed (i.e., prior to installation of the wear member on the earth working equipment), the marker 132 faces forward toward the front working edge 24 of the shroud 12.

Bore 108 can extend through the retainer 100. Bore 108 can include a threaded interior wall extending axially in an upper portion 108A for receiving a bolt 18 to secure the shroud 12 to the lip 14. A lower portion 108B of the bore forms a tool-receiving opening 122 which in this example is hex shaped compatible with a torque tool 124. The tool opening 122 and corresponding torque tool 124 may be different shapes in other embodiments as long as the respective shapes correspond with one another to rotate the retainer. Tool opening 122 can be centered on the bore axis or on the retainer axis or in a different position. Alternatively, bore 108 can be a blind bore closed at the end. Alternatively, bore 108 is threaded its entire length.

The retainer 100 includes one or more channels 112 extending longitudinally along the base portion 102. The channels 112 are sized and dimensioned to permit passage of the retainer into opening 152 past tabs or bosses 126 formed to project into the opening 152 on the leg 32. The channels 112 and bosses 126 cooperate to ensure that the retainer 100 is properly aligned with the recess. The channels and bosses could be reversed, and arrangements other than channels and bosses could be used. Although three tabs and channels are shown, more or fewer could be used.

The shroud 12 is secured to the lip 14 by a bolt 18. Prior to installing the shroud 12 onto the lip 14, the retainers 100 are first inserted into the openings 152. Each retainer 100 is positioned so that the channels 112 are aligned with the respective bosses 126 on the bottom surface 36 of the shroud 12. Once aligned, retainer 100 is inserted into the recess 152 and rotated so the bosses and channels are not aligned. The retainer is then held in the recess by the bosses for the balance of the installation. A holding member, which in this case is resilient member 22 (e.g., a rubber washer, a wave washer or other suitable retaining element) can be inserted underneath the retainer, i.e., between the retainer and the bosses. The resilient member tends to resist turning of the retainer during installation of the wear member. This helps keep the retainer in the position desired for installation of the bolt into the retainer. The resilient member can also ensure the retainer remains in the opening prior to the insertion of the bolt even if the retainer rotates to align the channels with the bosses of the opening. The washer 22 can be flexed to fit into the opening 152 past the tabs 126 and then un-flexed such that the resilient member sets on the tabs to hold the retainer in the recess. Other arrangements are possible to hold the holding member 22 in the recess and/or to hold the retainer in the opening.

With the retainer and lower washer in opening 152, the shroud 12 is positioned onto the lip 14, with lip 14 positioned between the top leg 30 and the bottom leg 32. The opening 48 of the lip can be offset from the opening 152 of the shroud if the shroud is not fully seated on the lip. Tool 124 is inserted through lip opening 48 and bore 108 (from above) to engage tool opening 122. Turning the tool 124 rotates retainer 100 to bring openings 48 and bore 108 into alignment. At full rotation, lug 106 sits against stop 130 in bore 108. The stop limits the rotation range of the retainer in the recess. In some embodiments, the retainer may be rotated up to 190° within the recess 152 though greater or lesser rotations are possible.

Once the retainer bore 108 is aligned with opening 48 the tool is withdrawn and bolt 18 is threaded into the bore 108 to secure the shroud 12 onto the lip 14. Torqueing of bolt 18 increases the normal force between the shroud and the lip. Torqueing of bolt 18 can also rotate retainer 100 in recess 152. As a wide portion 114 of retainer 100 rotates rearward in the recess, bolt 18 bears on the lip opening 48 and retainer 100 bears on opening 152 to urge the shroud onto the lip. Accessing retainer components only from above the lip provides the operator easy access and allows the operator to maintain a safe position.

In an alternative embodiment, rotation of the tool 124 rotates retainer 100 in the recess and the shaft of the tool bears on opening 48 of the lip to urge the shroud farther onto the lip. The tool is then removed from the bore and replaced by the bolt to secure the shroud to the lip.

Alternatively, final adjustment of the shroud includes receiving tool 124 in tool opening 122 from underneath the shroud to rotate the retainer. The eccentric retainer in the recess 152 is rotated by tool 124 to align bore 108 with lip opening 48 and the bolt is then threaded into the bore. The torque tool is again rotated to move the wider portion 114 of the retainer 100 to the rear of the recess 152 and the bolt 18 bears on lip 12 in opening 48. This shifts the shroud rearward onto the lip until the shroud recess face 42 is pulled snug onto the lip front edge 38. The bolt 18 is torqued down to hold the shroud in position in relation to the lip while the tool maintains torque on the retainer urging the shroud tight on the lip simultaneous with tightening the bolt. In some embodiments, the tool opening 122 is larger than the diameter of the upper portion of the bore.

In another embodiment shown in FIGS. 9-14, retainer 20 is an eccentric retainer 200 with top and bottom tabs 206 and 210 extending radially. Similar to retainer 100, retainer 200 includes a base portion 202, which is generally cylindrical, and a cap portion 204, which is generally a truncated cone. The base and cap portions, though, could have other shapes. Bore 208 is eccentrically located in the retainer. The eccentricity creates a narrow side portion 226 and a wide side portion 224 in retainer 200, with reference to a bore axis BA. The bore axis BA is offset from a longitudinal axis LA of the retainer. In another alternative, the retainer is not eccentric and does not provide take up.

The cap portion 204 generally tapers inwardly from the base portion 202 toward a top surface 210. In some embodiments, the cap portion 204 may taper at an angle β ranging between 45 and 75 degrees. In other embodiments, the angle β may range between 50 and 60 degrees. Other larger and smaller tapers may be used. Alternatively the cap portion sides can be arcuate in cross section. Other arrangements are possible; e.g., different angles and non-uniform inclinations can be used.

Opening or recess 252 includes upper and lower circumferential slots 212 and 214 in the wall of the recess extending radially. The retainer 200 can be received in the opening 252 canted at an angle so the upper tab 206 can seat in the upper slot 212. The retainer is then rotated to vertical so the lower tab 210 passes through lower tab opening 210A. The retainer is then rotated about so tab 210 moves into slot 214 and spaced from the tab opening 210A. The tabs in the upper and lower slots keep the retainer in the recess for the balance of the installation. A holding member such as in the form of a lower washer 22 can be received in slot 214 with tab 210 for retention of the retainer in the recess. In this embodiment the upper slot 212 can correspond to opening 50.

Alternatively, a second tab opening can receive tab 206 simultaneous with the lower tab opening 210A receiving tab 210 without canting the retainer. Rotating retainer 200 about longitudinal axis LA, the upper and lower tabs move into the slots 212 and 214.

With the retainer received in the opening, the shroud is mounted to the lip. The tool can be received through the upper portion 208A of the bore and engages tool opening 222 in the lower portion 208B of the bore. If needed, the retainer can be rotated in the opening to align the bore 208 with the lip opening 48. The tabs rotate in the upper and lower slots as the retainer rotates. The bolt is threaded into bore 208. The wide portion 224 of the retainer rotates rearward in the opening to urge the shroud on the lip. The upper slot can include a stop 216 that abuts the tab at a certain rotation to limit rotation of the retainer between a full forward rotation position and a full rearward rotation position. The retainer can rotate up to 190 degrees. Alternatively, the retainer can rotate up to 270 degrees. Other slots and stop configurations are possible.

Alternatively, as described above, the tool can engage tool opening 222 from underneath. The retainer is rotated with the tool 124 to urge the shroud fully onto the lip. The bolt is torqued simultaneously further wedging the wide portion of the retainer into the rear of the recess and the shroud on the lip.

When the shroud 12 becomes worn, the shroud 12 may be removed from the lip 14 by first disengaging the bolt 18 from the retainer 200. Erosion of the shroud can remove material from the bottom surface of the lower leg and the retainer. The lower half of the retainer can be eroded away with lower tab 210. Initial rotation of the bolt allows the retainer 200 to separate from bearing wall 60 allowing it to spin in recess 252. The upper tab 206 contacting stop 216 limits rotation of the retainer so torque applied to the bolt head can overcome friction engagement between bolt 18 and bore 208. Once the bolts 18 are removed, the shroud 12 may be separated from the lip 14 and a new shroud may be attached.

Figure 15:
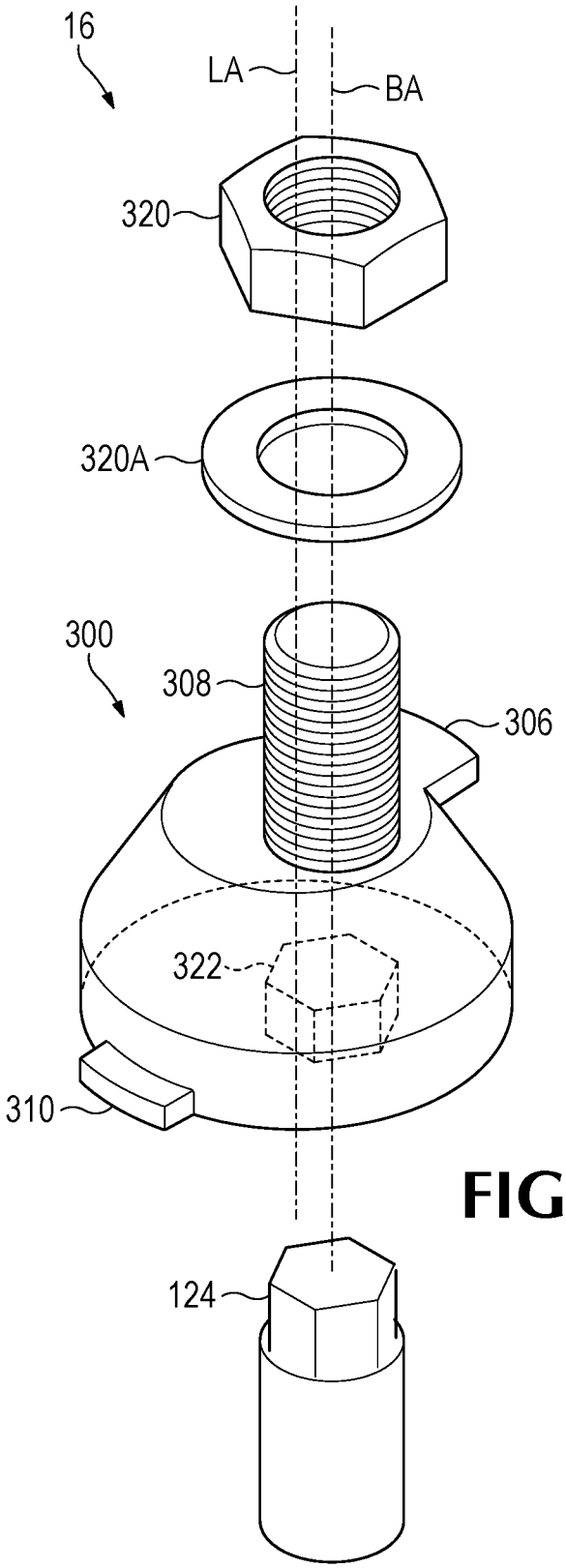
FIG. 15 is an exploded, perspective view of fastener with another embodiment of a retainer.

In an alternative embodiment, the retainer could be formed with a stud 310 as shown in FIG. 15 in place of a bore that receives a bolt. Retainer assembly 316 can include a nut 320 and upper washer 320A to engage stud 310. Retainer 300 includes upper and lower tabs 306 and 310 similar to retainer 200. Threaded stud 310 extends from the top surface of the retainer. When assembled to the lip and wear member, the retainer is received in an opening of the wear member as previously described and the stud extends through opening 48. Upper washer 320A with nut 320 threaded to the stud secures the wear member to the lip. Stud 320 with a stud axis BA is offset from a main axis of the retainer LA. The retainer includes an opening 322 at a bottom surface to receive torque tool 124. The retainer can be installed in a similar manner as previously described. The end of the stud can be configured to receive a torque tool in addition or instead of opening 322. The end of the stud can be formed as an opening or a head to receive the tool.

In any of the embodiments, rotation of the retainer in the shroud opening can be a function of friction between the surfaces of the retainer and the opening and/or engagement between fastener and the retainer. A number of methods can be employed to increase or decrease friction between the retainer and the recess. The surface of the retainer and/or the recess can be modified by adding rubber buttons that engage the opposite surface or opposite buttons to increase friction. One or more surfaces can be coated with a material to increase or decrease friction such as a lubricant, a paint or a resilient coating. A sleeve, washer or spring can be inserted between the recess and the retainer to increase or decrease friction. The lower washer can function to increase friction between the retainer and the opening. The lower washer can be a cone washer to apply an upward force to the retainer and increase contact force between the recess surface and the retainer surface. Other washers such as a wavy washer or a compressible washer can be used. The lower washer can also increase the contact force at the lower face bushings at the recess opening.

Engagement of the fastener with the retainer can be modified. In some embodiments it is preferred that the torque transferred from the bolt to the retainer substantially increases at the bottom of the bore as the bolt advances in the bore. Threads of the bore in the lower portion can be modified or deformed to engage the threads of the bolt with more friction, increasing the torque applied to the retainer as the bolt advances past a depth of the bore. Alternatively or in addition, material can be applied to the bottom threads such as a thread locker to engage the bolt with more friction. Alternatively, or in addition, a polymer collar can be installed in the bore similar to a nylon-insert lock nut that engages the bolt with more friction. Alternatively or in addition, washer can be a Bellville washer or wavy washer that increases the force applied to the retainer as the fastener advances into the bore and the bolt head engages the washer. Alternatively or in addition, a spring or resilient component can be placed in the bottom of the bore to engage the bolt after it advances a set distance into the bore that increases engagement of the retainer in the bore.

Alternatively or in addition, an object such as a ball bearing can be placed in the bottom of the bore to engage the bolt after it advances a set distance into the bore. The end of the bolt engaging the ball bearing increases the torque on the retainer to overcome friction with the recess surface. The ball bearing can be a hard material with little deflection or can be brass, aluminum or a polymer that increases resistance to advancement of the bolt but deflects with the increased force of the bolt. In some embodiments, with adequate rotation of the retainer, the bolt is removed, the ball bearing is removed and the bolt returned to the bore to secure the shroud to the lip.

Alternatively or in addition, the bolt can include another material attached to the end of the bolt. For example, a rubber bumper at the end of the bolt can engage the bottom of the bore. As the bolt advances the bumper will compress increasing the torque transferred to the retainer. Other materials than rubber can be used.

Alternatively or in addition, an extra long bolt can be initially threaded into the bore that engages the bottom of the bore before the bolt head engages the lip. All the torque applied to the bolt is then transferred to the retainer to fully tighten the retainer and fully urge the shroud onto the lip. The long bolt is then removed and a shorter bolt is then threaded to the bore to secure the shroud to the lip.

The wear assembly can provide efficient replacement of worn wear members, efficient retightening of wear members on the lip and/or safe access to the retainer assembly from the top of the lip. The wear assembly can reduce downtime and/or operating expenses for earthmoving equipment.

With reference to the drawings, this specification describes particular embodiments and their detailed construction and operation. The embodiments described are set forth by way of illustration only and not limitation. The described features, structures, characteristics, and methods of operation may be combined in any suitable manner in one or more embodiments. In view of the disclosure herein, those skilled in the art will recognize that the various embodiments can be practiced without one or more of the specific details or with other methods, components, materials, or the like. In other instances, well-known structures, materials, or methods of operation are not shown or not described in detail to avoid obscuring more pertinent aspects of the embodiments. It is intended that subject matter disclosed in any one portion herein can be combined with the subject matter of one or more other portions herein as long as such combinations are not mutually exclusive or inoperable. In addition, many variations, enhancements and modifications of the concepts described herein are possible. Those skilled in the art will recognize that many variations can be made to the details of the above-described embodiments without departing from the underlying principles of the invention.

The invention claimed is:

1. A method of installing a wear member onto a lip of earth working equipment comprises:

installing a retainer in an opening in the wear member;

positioning the wear member on the lip with the retainer in the opening so the opening in the wear member is aligned with an opening in the lip;

engaging the retainer with a tightening member to secure the wear member to the lip, wherein a main axis of the tightening member is parallel to and offset from a main axis of the retainer; and rotating the tightening member to turn the retainer to urge the wear member rearwardly onto the lip.

2. The method of claim 1 where positioning the wear member onto the lip includes fitting a leg of the wear member on each of opposite sides of the lip.

3. The method of claim 1 where the tightening member is a bolt received in a threaded bore of the retainer.

4. The method of claim 1 where the retainer includes a threaded stud extending through the opening in the lip, and the tightening member is a nut that threads onto the stud.

5. The method of claim 1 where the tightening member pulls the retainer against a bearing surface in the opening of the wear member.

6. The method of claim 5 where the bearing surface in the opening in the wear member against which the retainer is pulled by the tightening member diverges in a direction away from the lip.

7. A wear assembly for earth working equipment comprising:

a wear member with a wear surface to contact earthen material, an inner surface defining a cavity to receive a portion of the earth working equipment and an opening extending from the inner surface to an outer surface having a bearing surface;

a retainer rotatably secured in the opening and including a bore, wherein the bore includes a threaded portion with a thread axis parallel to and offset from a main axis of the retainer such that the retainer is eccentric; and a tightening member to contact the earth working equipment and engage the retainer to pull the retainer toward the bearing surface and secure the wear member to the earth working equipment.

8. The wear assembly of claim 7 where rotation of the retainer in the opening urges the wear member laterally onto the earth working equipment.

9. The wear assembly of claim 7 where the bearing surface of the opening is adjacent the inner surface.

10. The wear assembly of claim 7 where the bearing surface of the opening diverges toward the outer surface and the retainer in the opening includes a diverging cap to bear against the bearing surface in the opening.

11. The wear assembly of claim 7 where the retainer includes a threaded stud and the tightening member is a nut received on the stud, and the thread axis is a stud axis and wherein rotation of the nut causes the retainer to turn about the stud axis to move the wear member in a direction transverse to the stud axis to tighten a fit of the wear member on the earth working equipment.

12. The wear assembly of claim 7 where the wear member includes two rearward extending legs spaced apart to form the cavity that receives the portion of the earth working equipment.

13. The wear assembly of claim 12 where the retainer opening is formed in one of the legs with the other of the legs ending forward of the opening.

14. The wear assembly of claim 7 where the cavity is open at opposite sides to receive a laterally extending lip of the earth working equipment.

15. The wear assembly of claim 7, wherein the retainer has a base and a cap portion, the cap portion being a truncated cone.

16. The wear assembly of claim 15 where the tightening member is a bolt threaded into the threaded portion of the bore and the bore opens in the cap portion to receive a bolt, and wherein rotation of the bolt causes the retainer to turn about the thread axis to move the wear member in a direction transverse to the thread axis to tighten a fit of the wear member on the earth working equipment.

17. The wear assembly of claim 7, wherein the retainer is rotatably secured in the opening independent of the tightening member.

18. A wear assembly for earth working equipment comprising:

a wear member to contact earthen material including a mounting portion for securing the wear member to the earth working equipment, the mounting portion including an inner surface to face the earth working equipment, an opposite outer surface, and an opening including a bearing surface and at least one tab or slot;

a retainer including a complementary at least one other tab or slot to permit insertion of the retainer into the opening in at least one orientation and to preclude removal of the retainer from the opening in at least one other orientation; and a tightening member to contact the earth working equipment and engage the retainer to pull the retainer against the bearing surface and thereby secure the wear member to the earth working equipment.

19. A wear member for earth working equipment comprising:

a front end to contact earthen material;

a mounting portion for securing the wear member to the earth working equipment, the mounting portion including an inner surface to face the earth working equipment, an opposite outer surface;

an opening extending from the inner surface to the outer surface to receive a retainer to secure the wear member to the earth working equipment, the opening including a bearing surface; and at least one tab or slot associated with the opening to receive a complementary tab and/or slot on the retainer to permit insertion of the retainer into the opening in one at least one orientation and to preclude removal of the retainer from the opening in at least one other orientation.

* * * * *